United States Patent [19]

Wiczer

[11] Patent Number: 4,459,440

[45] Date of Patent: Jul. 10, 1984

[54] JOYSTICK AND SWITCH ASSEMBLY THEREFOR

[75] Inventor: Max Wiczer, Skokie, Ill.

[73] Assignee: Wico Corporation, Niles, Ill.

[21] Appl. No.: 477,128

[22] Filed: Mar. 21, 1983

[51] Int. Cl.[3] ..... H01H 25/00

[52] U.S. Cl. ..... 200/6 A; 200/246; 200/283

[58] Field of Search ..... 200/1 A, 1 TK, 5 R, 200/6 A, 17 R, 18, 153 K, 245-247, 283, 284

[56] References Cited

U.S. PATENT DOCUMENTS 4,196,328 4/1980 Ishikawa ..... 200/246

4,382,166 5/1983 Kim ..... 200/18 X

*Primary Examiner*—J. R. Scott

*Attorney, Agent, or Firm*—Emrich & Dithmar

[57] ABSTRACT

A switch assembly is provided for mounting in the two-part body of a joystick apparatus. The assembly includes a circuit board held between retainers on the two parts of the body. Four leaf spring switch modules are mounted on the board, each module comprising a switch body having two spaced-apart pockets therein for respectively receiving leaf spring switch blades, the contact portions of which project from the body and are respectively backed by fingers on the body, one of which is relatively flexible. The switch bodies are secured in place by pins which extend through openings in the board and are peened over on the opposite end thereof. Terminal legs on the switch blades extend through complementary slots in the circuit board. The pivotally mounted joystick actuator extends through an opening in the center of the circuit board for engagement with the flexible fingers of the switch bodies.

20 Claims, 8 Drawing Figures

FIG. 3
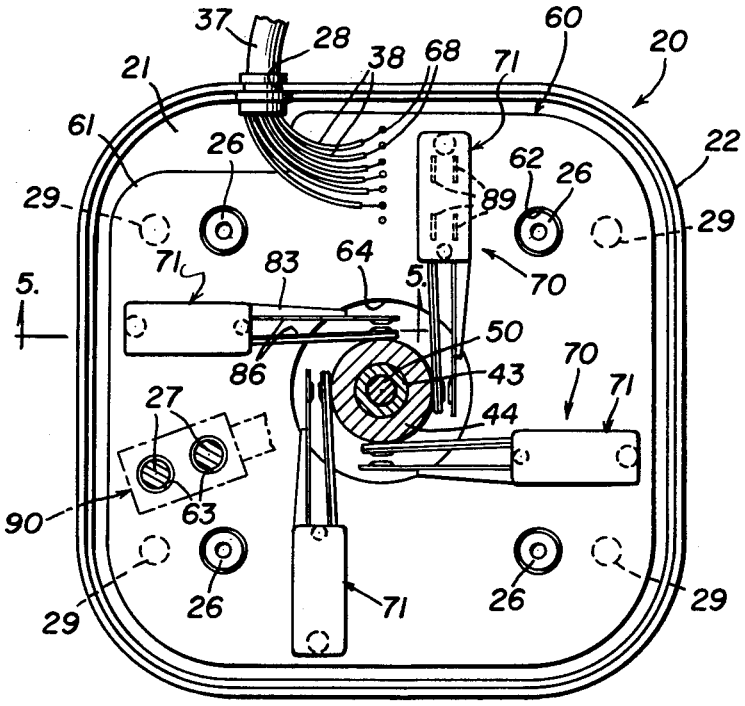
FIG. 4
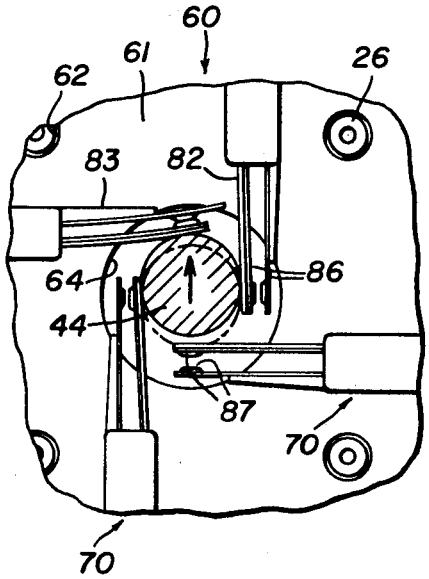
FIG. 5
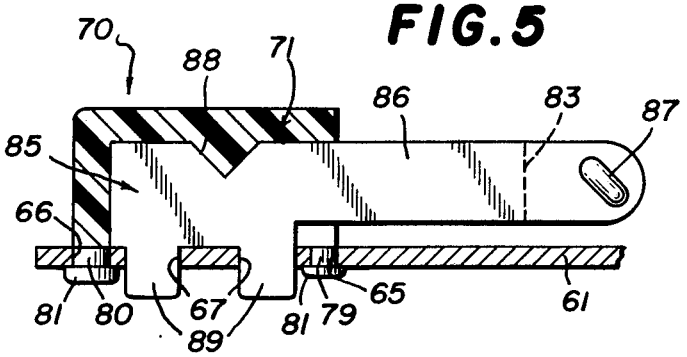
FIG. 6
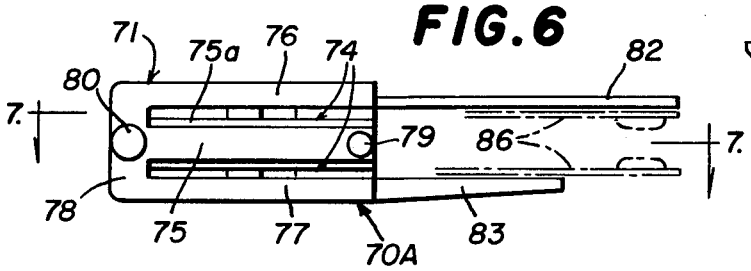
FIG. 8
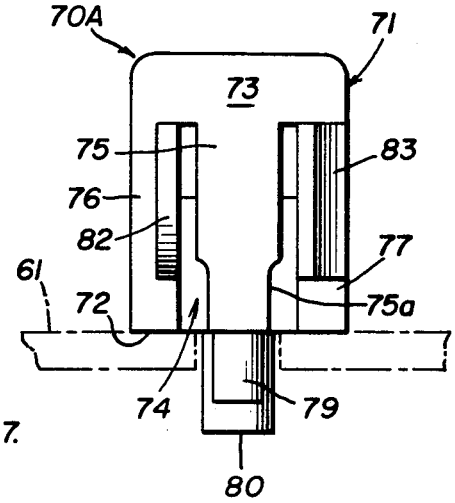
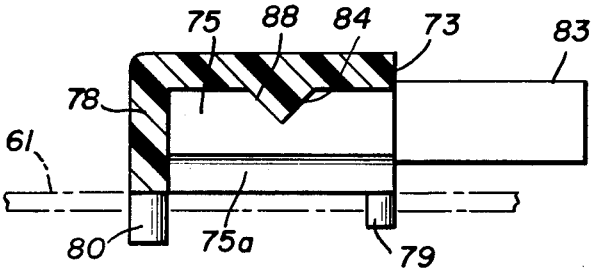
FIG. 7

JOYSTICK AND SWITCH ASSEMBLY THEREFOR

BACKGROUND OF THE INVENTION

The present invention relates to a joystick controller for electric switches, of the type which is used for controlling the operation of certain electronic games and the like. In particular, this invention is an improvement of the joystick controller disclosed in copending U.S. application Ser. No. 327,261, filed Dec. 3, 1981, now U.S. Pat. No. 4,382,166 and commonly assigned with the present application.

Prior joystick controllers, including that disclosed in the aforementioned application, include a housing enclosing a plurality of switches which may include, for example, direction control switches and a fire control switch, and handle means tiltably mounted on the housing for movement to actuate the direction control switches. The handle may include a push button for actuating the fire control switch. The switches used in these prior joystick controllers are leaf switches comprising a switch body molded around a pair of leaf spring switch blades. Discrete receptacles or sockets for the direction control switches are provided in the housing, and the switches are then interconnected by copper wires which are in turn connected to a control cable.

This prior arrangement is relatively expensive because of the use of standard molded leaf switch units which must be individually hand-wired in the housing.

SUMMARY OF THE INVENTION

The present invention relates to an improved joystick controller which avoids the disadvantages of prior controllers while affording additional structural and operating advantages.

It is a general object of this invention to provide a switch assembly for a joystick controller which is of simple and economical construction.

In connection with the foregoing object, it is another object of this invention to provide a switch assembly of the type set forth which includes a plurality of switches and which can be mounted as a unit in the joystick controller housing.

It is still another object of this invention to provide a switch assembly of the type set forth, which eliminates wiring among the several switches.

Still another object of this invention is the provision of a joystick controller which incorporates a switch assembly of the type set forth.

These and other objects of the invention are attained by providing a switch assembly for a joystick apparatus comprising: a circuit board; and at least one leaf switch module carried by the circuit board, each of the switch modules including an electrically insulating switch body having two spaced-apart pockets therein, two flexible resilient leaf spring switch blades respectively received in the pockets and having contact portions thereof projecting from the switch body in substantially parallel spaced-apart relationship, and means mounting the switch body on the circuit board in a mounted configuration, the switch body in the mounted configuration thereof cooperating with the circuit board for fixedly holding the switch blades in place on the circuit board.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 3 is a view in horizontal section taken along the line 3—3 in FIG. 2;

FIG. 4 is a fragmentary view of the central portion of FIG. 3, and illustrating movement of the joystick actuator for closing one of the direction control switches;

FIG. 5 is an enlarged view in vertical section taken along the line 5—5 in FIG. 3 and illustrating one of the switch modules of the present invention;

FIG. 6 is a bottom plan view of the switch module illustrated in FIG. 5;

FIG. 7 is a view in vertical section taken along the line 7—7 in FIG. 6; and FIG. 8 is a further enlarged end elevational view of the switch housing of FIG. 5, as viewed from the right-hand end thereof, with the switch blades removed.

DESCRIPTION OF THE PREFERRED EMBODIMENT

Figure 2:
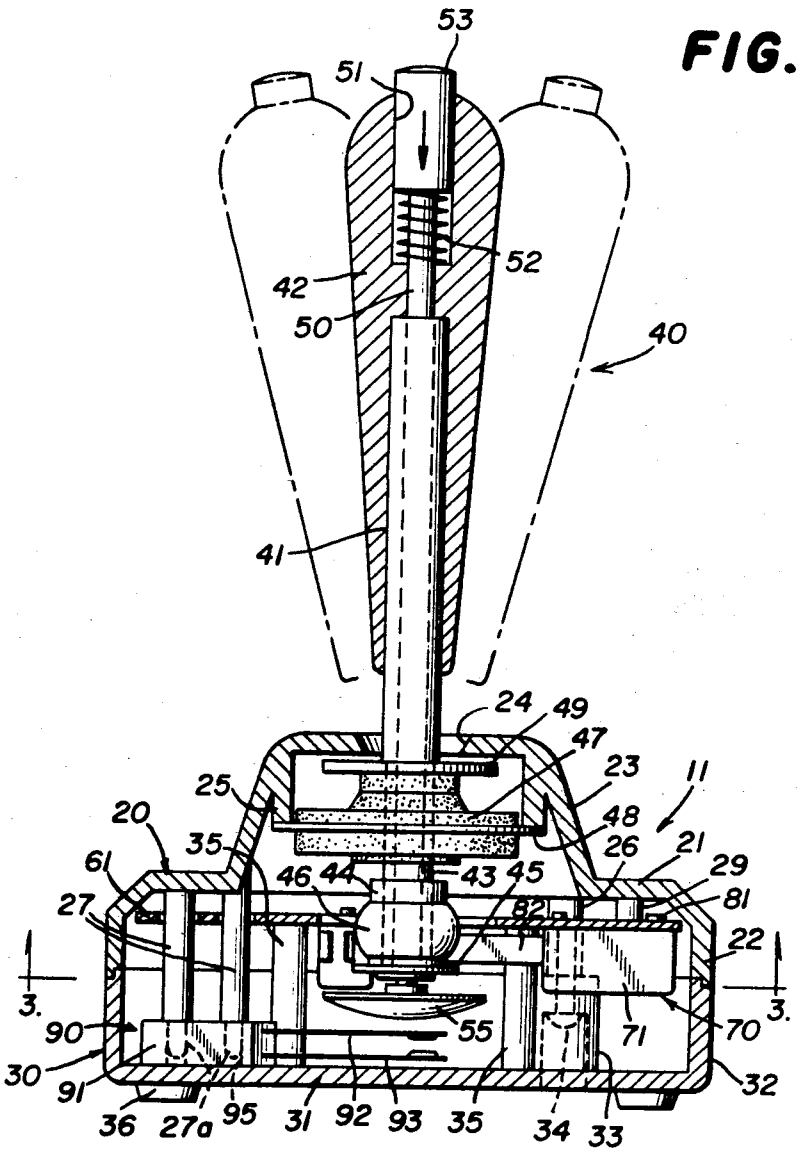
FIG. 2 is a view in vertical section taken along the line 2—2 in FIG. 1, and illustrating movement of the joystick handle.
Figure 1:
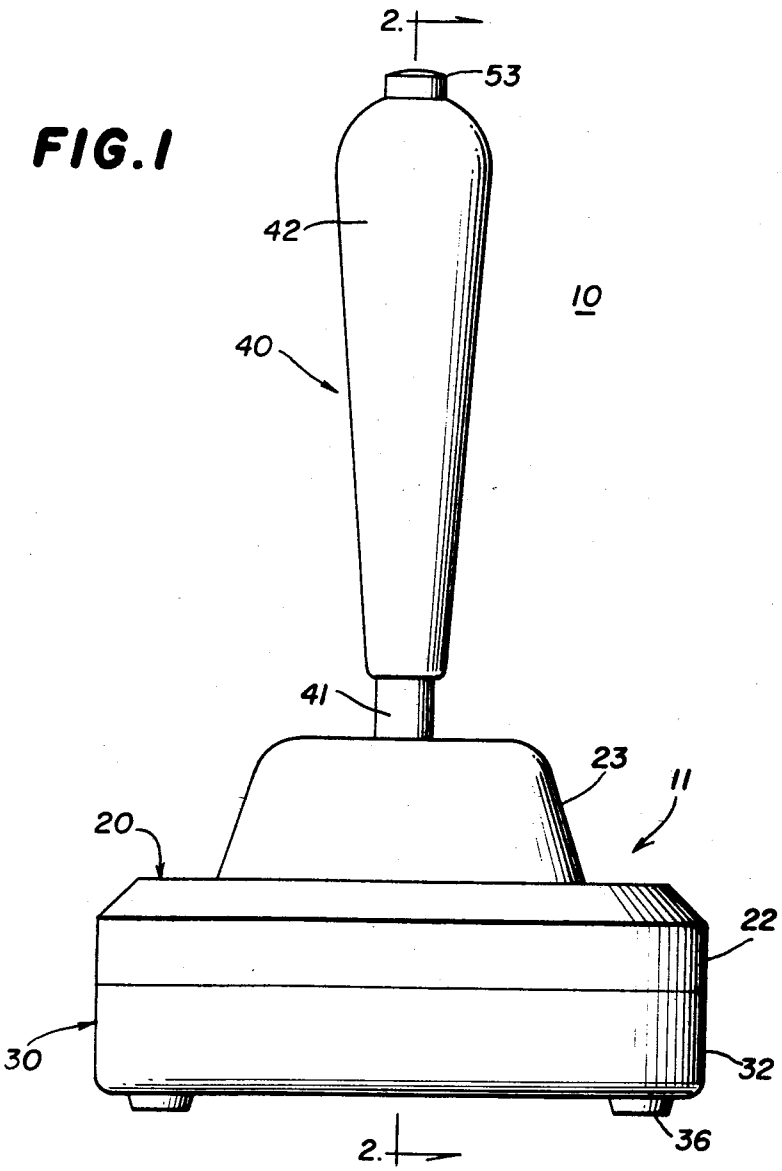
FIG. 1 is a side elevational view of a joystick controller incorporating a switch assembly constructed in accordance with and embodying the features of the present invention.

Referring now to FIGS. 1 through 4 of the drawings, there is illustrated a joystick controller, generally designated by the numeral 10. The joystick controller 10 has a two-part housing, generally designated by the numeral 11, which includes a cover or top 20 and a bottom 30 which cooperate to form a substantially closed housing. The cover 20 has a generally rectangular top wall 21 provided around the peripheral edges thereof with a continuous depending skirt or side wall 22. Integral with the top wall 21 centrally thereof and projecting upwardly therefrom is a turret 23 which may be generally frustoconical or frustopyramidal in shape, having a circular aperture 24 in the upper end thereof. Integral with the inner surface of the turret 23 around the perimeter thereof and depending therefrom is a support flange 25 (see FIG. 2). Integral with the inner surface of the top wall 21 and depending therefrom respectively adjacent to the four corners thereof are four attachment posts 26, each having an internally threaded bore extending axially into the distal end thereof. Also integral with the inner surface of the top wall 21 and depending therefrom beneath the lower edge of the skirt 22 are two attachment posts 27, each having a reduced diameter portion 27*a* at the distal end thereof. The lower edge of the skirt 22 has an arcuate notch or cutout 28 therein (see FIG. 3). Also integral with the inner surface of the top wall 21 and depending therefrom are four short retaining studs 29 (see FIGS. 2 and 3), for a purpose to be explained more fully below.

The bottom 30 of the housing 11 includes a generally rectangular bottom wall 31 integral at the perimeter thereof with a continuous upstanding skirt or side wall 32. The edges of the skirts 22 and 32 of the cover 20 and bottom 30, respectively, are flanged for mating engagement with each other for cooperation to form a closed housing. Integral with the bottom wall 31 and projecting upwardly therefrom substantially normal thereto are four hollow attachment tubes 33, each being provided with a recess at the distal end thereof, the attachment tube 33 being respectively disposed for alignment with the attachment posts 26 of the cover 20. More specifically, the distal ends of the attachment posts 26 are received in the recesses in the upper ends of the attachment tubes 33. Fasteners, such as screws 34 are received through the attachment tubes 33 from the lower ends thereof and are threadedly engaged with the attachment posts 26 securely to hold the cover 20 and the bottom 30 together in an assembled, closed configuration illustrated in FIGS. 1 and 2. Also integral with the bottom wall 31 and projecting upwardly therefrom beyond the upper edge of the skirt 32 are four retaining posts 35. Fixedly secured to the outer surface of the bottom wall 31 respectively adjacent to the four corners thereof are four foot pads 36. A cable 37 is received through the notch 28 in the cover 20, the cable 37 including a plurality of wires 38 which are electrically connected to the circuitry of the joystick controller 10 in a manner to be described more fully below.

Mounted on the cover 20 is a handle assembly generally designated by the numeral 40, which includes an elongated cylindrical tube 41 extending through the aperture 24 and having a reduced diameter inner end 43 (see FIGS. 2 and 3) which extends through and is fixedly secured to a flexible diaphragm 47. The outer end of the tube 41 extends outwardly well beyond the turret 23 and has fixedly secured thereto in surrounding relationship therewith a handle 42. Insert molded in the flexible diaphragm 47 is a mounting plate 48 which is fixedly secured to the lower end of the support flange 25 by suitable means (not shown). Disposed in surrounding relationship with the inner end of the reduced diameter portion 43 is an actuator 44 which is retained in place by a E-ring 45. The actuator 44 has an arcuate contact surface 46. A compression spring (not shown) may be disposed in surrounding relationship with the reduced diameter portion 43 of the tube 41 between the actuator 44 and the flexible diaphragm 47 for holding the actuator 44 against the E-ring 45. A washer 49 is disposed in surrounding relationship with the tube 41 between the flexible diaphragm 47 and the top wall of the turret 23.

An elongated rod 50 extends through the tube 41 and projects beyond the ends thereof. The handle 42 has an axial bore 51 in the upper end thereof, into which the upper end of the rod 50 projects. Disposed in the bore 51 in surrounding relationship with the upper end of the rod 50 is a helical compression spring 52, the upper end of which bears against a push button 53 which is fixedly secured to the upper end of the rod 50 and projects outwardly beyond the adjacent end of the handle 42. The inner end of the rod 50 extends beyond the inner end of the tube 41 and has press-fitted thereonto an actuator 55. It will be appreciated that the compression spring 52 acts to urge the rod 50 to a normal rest position, illustrated in FIG. 2, wherein the actuator 55 is held against the lower end of the tube 41.

It is a significant aspect of the present invention that the joystick controller 10 includes a direction control switch assembly, generally designated by the numeral 60, constructed in accordance with and embodying the features of the present invention. The switch assembly 60 includes a flat printed circuit board 61 which is dimensioned to fit within the housing 11 substantially parallel to the top and bottom walls 21 and 31, as is best illustrated in FIGS. 2 and 3. In use, the printed circuit board 61 has the upper or printed surface thereof seated against the retaining studs 29, the printed circuit board 61 having holes 62, 63 and 64 therein for respectively receiving the attachment posts 26, the mounting posts 27 and the actuator 44 therethrough (see FIG. 3). The printed circuit board 61 also has formed therethrough at equidistantly spaced-apart locations thereon, four sets of holes, each set including a small circular hole 65, a larger circular hole 66 and four slots 67 (see FIG. 5) for a purpose to be described below. Also formed in the printed circuit board 61 are a series of wire terminal holes 68 (see FIG. 3) for respectively receiving the ends of the wires 38 of the cable 37, which wire ends may then be soldered in place for connection to the printed circuit on the board 61 in a well known manner.

The switch assembly 60 also includes four leaf switch modules, each generally designated by the numeral 70, and substantially identical in construction, wherefore only one will be described in detail. Referring now also to FIGS. 5 through 8 of the drawings, each of the leaf switch modules 70 includes a molded body 70A of electrically insulating plastic which includes a block 71 and fingers 82 and 83. The block 71 is generally in the form of a regular hexahedron, and including a flat rectangular attachment surface 72 (FIG. 8) which intersects and is substantially perpendicular to a rectangular contact surface 73. Formed in the attachment surface 72 are two spaced-apart slots or pockets 74, each of which also intercepts and opens to the contact surface 73 and is substantially perpendicular thereto. The slots 74 are separated by a web 75 provided with tapered sides **75*a* at the distal edge thereof adjacent to the attachment surface 72. The outer sides of the slots 74 are respectively bounded by side walls 76 and 77 which are parallel to the web 75 and are interconnected at the end of the block 71 opposite the contact surface 73 by an end wall portion 78. Integral with the attachment surface 72 and projecting therefrom substantially perpendicular thereto are a small-diameter pin 79 and a larger-diameter pin 80, the pins 79 and 80 being respectively disposed adjacent to opposite ends of the web 75. In use, the body 70A is adapted to be mounted on the under or component side of the printed circuit board 61, with the pins 79 and 80 respectively received through the holes 65 and 66, and with the attachment surface 72 flush against the printed circuit board 61. The pins 79 and 80 have a length sufficient to extend all the way through the printed circuit board 61, the distal ends thereof then being peened over to form enlarged heads 81 (see FIG. 5) securely to hold the body 70A** in place.

The body 70A also includes a relatively long, flexible finger 82 integral with the contact surface 73 and projecting therefrom substantially perpendicular thereto as an extension of the side wall 76. The finger 82 is substantially flat and rectangular, with the inner surface thereof being disposed substantially coplanar with the inner surface of the side wall 76. The body 70A also includes a relatively short, inflexible finger 83 which projects from the contact surface 73 as an extension of the side wall 77 and substantially parallel to the finger 82. The finger 83 has a flat rectangular inner surface which is disposed substantially coplanar with the inner surface of the side wall 77. Integral with the block 71 and projecting respectively into the slots 74 are two triangular lugs 84.

The leaf switch module 70 also includes two flat leaf spring metal switch blades 85 which are respectively adapted to be disposed in the slots 74 of the block 71. Each of the switch blades 85 has an elongated contact arm 86 provided with an embossed contact 87 adjacent to the distal end thereof. A triangular notch 88 is formed in one edge of each switch blade 85, the opposite edge having projecting therefrom two spaced-apart flat terminal legs 89 (see FIGS. 3 and 5).

In assembly, the switch blades 85 are respectively inserted in the slots 74 of the block 71, with the triangular lugs 84 being respectively received in the triangular notches 88, accurately to position the switch blades 85 in the slots 74. In this assembled configuration, the terminal legs 89 project beyond the attachment surface 72 of the block 71 and are respectively receivable through the slots 67 in the printed circuit board 61 when the body 70A is disposed in its mounted configuration with the pins 79 and 80 respectively disposed in the holes 66 and 67 in the printed circuit board 61 (see FIG. 5). In this mounted configuration, the switch blades 85 are held substantially immovably with respect to the body 70A and the printed circuit board 61. Also, in this mounted configuration it will be appreciated that the contact arms 86 of the switch blades 85 respectively extend along the facing inner surfaces of the fingers 82 and 83, the length of the contact arms 86 being such that they extend substantially to the end of the long finger 82. The switch blades 85 are arranged so that the contacts 87 face each other for mutual contact. Preferably, each of the contacts 87 is in the form of an elongated oval embossment, the contacts 87 being arranged with the longitudinal axes thereof disposed substantially perpendicular to each other for more positive contact. In operation, the long finger 82 is deflectable for deflecting the associated contact arm 86 toward the other contact arm 86 for closing the switch contacts, the short finger 83 supporting the other contact arm 86 and limiting deflection thereof.

Referring in particular in FIG. 3, the switch modules 70 are so arranged on the printed circuit board 61 that the outer surfaces of the long fingers 82 are respectively tangent to the arcuate contact surface 46 of the actuator 44 at equiangularly spaced-apart points thereon. Thus, as the handle assembly 40 is tilted, as indicated in broken lines in FIG. 2, the actuator 44 deflects one or more of the long fingers 82 and the associated switch blade contact arms 86, for closing one or more of the direction control switches, as is indicated in FIG. 4, all in a well known manner.

The joystick controller 10 also includes a fire control switch 90 which is a leaf spring switch having a molded body 91, a movable contact arm 92 and fixed contact arm 93, the body 91 having bores 95 therethrough for respectively frictionally receiving therein the reduced diameter ends of the mounting posts 27 for holding the fire control switch 90 in its mounted condition (see FIGS. 2 and 3). In this condition, the contact arms 92 and 93 extend beneath the actuator 55 for engagement and operation thereby to close the contacts of the fire control switch 90 when the push button 53 is depressed in the direction of the arrow in FIG. 2.

It is a fundamental aspect of this invention that it affords an inexpensive and greatly simplified assembly of the joystick controller 10. In particular, it will be noted that the direction control switch assembly 60 can be preassembled as a unit, with all of the switch modules 70 mounted in place on the printed circuit board 61 and with the terminal legs 89 of the switch blades 85 soldered to the printed circuit. The terminal wires of the fire control switch 90 can also be presoldered to the printed circuit, and the wires 38 of the cable 37 are inserted in the holes 68 and soldered to the printed circuit. This subassembly can then be simply set in place in the cover 20 with the attachment posts 26 and the mounting posts 27 and the actuator 44 of the handle assembly 40 all being received through the complementary openings in the printed circuit board 61. The actuator 55 is then press-fitted onto the end of the rod 50, and the fire control switch 90 is seated on the ends of the mounting posts 27. The cable 37 is then fitted into the notch 28 in the cover 20, and the bottom 30 is assembled with the cover 20 to complete the closure of the housing 11. The fasteners 34 are then applied securely to hold the housing 11 together. When the bottom 30 is thus assembled with the cover 20, the ends of the retaining posts 35 just touch the underside of the printed circuit board 61 and cooperate with the retaining studs 29 securely to clamp the printed circuit board 61 therebetween.

From the foregoing, it can be seen that there has been provided an improved joystick assembly and, in particular, an improved direction control switch assembly therefor which is of simple and economical construction, and minimizes the assembly to be done in the housing 11.

I claim:

1. A switch assembly for a joystick apparatus comprising: a circuit board; and at least one leaf switch module carried by said circuit board, each of said switch modules including an electrically insulating switch body having two spaced-apart pockets therein, two flexible resilient leaf spring switch blades respectively received in said pockets and having contact portions thereof projecting from said switch body in substantially parallel spaced-apart relationship, and means mounting said switch body on said circuit board in a mounted configuration, said switch body in the mounted configuration thereof cooperating with said circuit board for fixedly holding said switch blades in place on said circuit board.

2. The switch assembly of claim 1, wherein said switch body is of unitary one-piece construction.

3. The switch assembly of claim 1, wherein said circuit board is a printed circuit board.

4. The switch assembly of claim 1, wherein said switch body is substantially in the form of a regular hexahedron having first and second mutually perpendicular and intersecting outer surfaces, each of said pockets comprising a slot opening at both of said first and second surfaces, said switch body in its mounted configuration having said first surface disposed against said circuit board with said contact portions of said switch blade projecting from said second surface substantially parallel to said circuit board.

5. The switch assembly of claim 4, wherein said switch body includes means engageable with said switch blades for accurately positioning said switch blades in said pockets.

6. The switch assembly of claim 5, wherein said holding means includes two lugs respectively projecting into said pockets, each of said switch blades having a notch therein for receiving a corresponding one of said lugs.

7. The switch assembly of claim 1, wherein said mounting means comprises two pins integral with said switch body and projecting therefrom, said circuit board having two openings therein for respectively receiving said pins.

8. The switch assembly of claim 1, wherein each of said switch blades includes terminal legs projecting from the associated pocket substantially perpendicular to said contact portions, said circuit board having slots therethrough for respectively receiving said terminal legs when said switch body is disposed in the mounted configuration thereof.

9. A switch assembly for a joystick apparatus comprising: a circuit board; and at least one leaf switch module carried by said circuit board, each of said switch modules including an electrically insulating switch body having two spaced-apart pockets therein, first and second elongated fingers carried by said switch body respectively adjacent to said pockets and projecting from said switch body in generally parallel spaced-apart relationship, first and second flexible resilient leaf spring switch blades respectively received in said pockets and having contact portions thereof projecting from said switch body respectively along facing sides of said first and second fingers, said first finger being relatively stiff for supporting the contact portion of said first switch blade and said second finger being relatively flexible for accommodating deflection thereof and of the contact portion of said second switch blade toward the contact portion of said first switch blade, and means mounting said switch body on said circuit board in a mounted configuration, said switch body in the mounted configuration thereof cooperating with said circuit board for fixedly holding said switch blades in place on said circuit board.

10. The switch assembly of claim 9, wherein said fingers are unitary with said switch body.

11. The switch assembly of claim 9, wherein said first finger is substantially shorter than the contact portion of said first switch blade; said second finger being substantially equal in length to the contact portion of said second switch blade.

12. The switch assembly of claim 9, wherein the contact portions of said switch blades are disposed substantially parallel to said circuit board when said switch body is disposed in the mounted configuration thereof.

13. The switch assembly of claim 9, wherein said assembly includes four of said switch modules arranged so that when said switch bodies are in the mounted configurations thereof, said second fingers are disposed tangent to a common circle at equiangularly spaced-apart points therearound.

14. In a joystick apparatus including a housing carrying a pivotally mounted actuator for actuating one or more switches, the improvement comprising: a circuit board disposed within the housing, for each switch an electrically insulating switch body having two spaced-apart pockets therein, two flexible resilient leaf spring switch blades respectively received in said pockets and having contact portions thereof projecting from said switch body in substantially parallel spaced-apart relationship, means mounting said switch body on said circuit board in a mounted configuration, said switch body in the mounted configuration thereof cooperating with said circuit board for fixedly holding said switch blades in place in a normal open condition with one of said contact portions disposed for actuation by the joystick actuator, and retaining means on the housing engageable with said circuit board for holding it in place in the housing.

15. The joystick apparatus of claim 14, wherein the joystick housing comprises two parts, said retaining means including retaining members on each of said housing parts for holding said circuit board therebetween.

16. The joystick apparatus of claim 14, wherein said mounting means includes two pins projecting from said switch body, said circuit board having two openings therein for respectively receiving said pins.

17. The joystick apparatus of claim 14, wherein said switch body is substantially in the form of regular hexahedron having first and second mutually perpendicular and intersecting outer surfaces, each of said pockets comprising a slot opening at both of said first and second surfaces, said switch body in its mounted configuration having said first surface disposed against said circuit board with said contact portions of said switch blade projecting from said second surface substantially parallel to said circuit board, each of said switch blades having a notch therein, said switch body including two lugs respectively projecting into said pockets for engagement in said notches for accurately positioning said switch blades in said pockets.

18. The joystick apparatus of claim 14, wherein each of said switch blades has two terminal legs projecting from said switch body substantially perpendicular to said contact portion when said switch blades are disposed in said pockets, said circuit board having four slots therethrough for respectively receiving said terminal legs.

19. The joystick apparatus of claim 14, and further including, first and second elongated fingers carried by said switch body respectively adjacent to said pockets and projecting from said switch body in generally parallel spaced-apart relationship, said contact portions of said switch blades being respectively disposed along the facing sides of said first and second fingers when said switch blades are disposed in said pockets, one of said fingers being relatively flexible for accommodating deflection thereof and of the contact portion of the associated switch blade toward the contact portion of the other switch blade.

20. The joystick apparatus of claim 19, wherein said circuit board has an aperture therethrough centrally thereof for receiving the joystick actuator therethrough, the actuator having a circular actuating portion, the apparatus including four of the switches arranged on said circuit board so that said fingers are disposed in contact with said actuating portion at equiangularly spaced-apart points therearound.

* * * * *